United States Patent [19]

Potter

[11] 4,150,790

[45] Apr. 24, 1979

[54] REINFORCED MOLDED LIGNOCELLULOSIC CROSSTIE AND RAILWAY ASSEMBLY

[75] Inventor: Edward Potter, Beaverton, Oreg.

[73] Assignees: Edward Potter, Beaverton; Dant & Russell, Inc., Portland, both of Oreg.

[21] Appl. No.: 588,786

[22] Filed: Jun. 20, 1975

[51] Int. Cl.[2] ..... E01B 3/10

[52] U.S. Cl. ..... 238/83; 238/85; 238/91

[58] Field of Search ..... 238/29, 36, 37, 91, 238/30, 83, 84, 85; 264/122; 428/115, 222, 379, 188; 52/723, 722

[56] References Cited

U.S. PATENT DOCUMENTS

| | | | |
|---|---|---|---|
| 1,297,828 | 3/1919 | Garber | 238/85 |
| 2,082,399 | 6/1937 | Isman et al. | 238/83 X |
| 2,128,530 | 8/1938 | Hadley | 238/84 |
| 2,827,770 | 3/1958 | Bakker | 52/723 X |
| 2,847,733 | 8/1958 | Roy | 428/114 |
| 3,309,444 | 3/1967 | Schueler | 264/122 X |
| 3,804,935 | 4/1974 | Potter et al. | 264/122 |
| 3,908,902 | 9/1975 | Collins et al. | 238/83 |

FOREIGN PATENT DOCUMENTS

| | | | |
|---|---|---|---|
| 523559 | 11/1953 | Belgium | 238/29 |

*Primary Examiner*—Albert J. Makay
*Assistant Examiner*—Randolph A. Reese
*Attorney, Agent, or Firm*—Chernoff & Vilhauer

[57] ABSTRACT

A reinforced railroad crosstie formed by molding and bonding comminuted lignocellulosic material into a monolithic beam around a plurality of reinforcing rods, each of which has a plurality of spaced protrusions fixedly attached along its length at specific positions relative to the midpoint of the tie and the rails mounted thereon. The reinforcing rods are positioned within the crosstie proximate lines of maximum tensile stresses expected to be induced into the tie by different bending influences caused by passing trains and varying conditions of the underlying ballast. The protrusions are configured and spaced in pairs on either side of respective points of maximum expected stress to ensure maximum transfer of each stress from the lignocellulosic material to the rods. The rods are also positioned within the crosstie so as to avoid contact with the spikes employed to fasten the rail to the tie.

2 Claims, 6 Drawing Figures

REINFORCED MOLDED LIGNOCELLULOSIC CROSSTIE AND RAILWAY ASSEMBLY

BACKGROUND OF THE INVENTION

The present invention relates to a railroad crosstie of molded and bonded lignocellulosic material internally reinforced against certain specific positive and negative bending stresses expected from train operations. Most conventional railroad crossties used in this country today are lumber beams, approximately seven inches thick by nine inches wide by eight and a half feet long, that have been cut from sections of live tree trunks selected to be free from soft or decayed spots, shakes, worm holes, and other imperfections. Before being placed into service as crossties, these beams are treated with creosote, an oily liquid preservative, to protect them against the effects of exposure to the elements.

The major disadvantages of using lumber beams for railroad crossties are the ever-increasing costs of raw lumber, the difficulty of applying creosote with sufficient penetration to prevent rapid deterioration of the beams, and the need to continually replace and dispose of those beams that are split, rotted and worn. As an example of this latter problem, it has been reported that the Santa Fe railroad alone renews approximately 1.6 million lumber crossties annually. A few of these ties are sold to farmers and ranchers along the railroad right of way, but most must be buried underground as current ecological considerations prohibit their being burned in the open or left along the right of way for extended periods of time.

Previous attempts have been made to develop a substitute for the conventional wooden crosstie, such as by manufacturing the crossties from synthetic resins as shown in Groff U.S. Pat. No. 3,289,940, or from concrete, steel or thin particle board sheets made from recycled ties or other lignocellulosic materials and laminated together. These attempts have not been successful, however, due to the higher cost of the substitute crossties, lack of sufficient strength and durability in some cases to withstand the cyclic bending loads peculiar to crossties, non-adaptability of such substitute materials to the use of conventional rail-fastening spikes and, in the case of the metal substitutes, electrical conductivity of the material employed. Since the metal rails fastened to the ties to form the railway are also often utilized as electrical conductors for the railway signal system, it is imperative that the crossties be electrically non-conductive so as not to create an electrical circuit between the rails and thereby disrupt the signal system.

Accordingly, a need still exists for a substitute for the conventional wooden crosstie capable of successfully solving the problems of high cost, frequent replacement and wasteful and polluting disposal while retaining the strength and spike-holding capabilities of conventional crossties.

SUMMARY OF THE INVENTION

The present invention is directed to an economical, long-lasting, electrically non-conductive substitute for the conventional wooden railroad crosstie. More particularly, the crosstie of the present invention comprises a mixture of comminuted lignocellulosic material bonded together and molded in the form of a thick monolithic beam, having the dimensions required for a railroad crosstie, around a plurality of elongate reinforcing members. The preferred lignocellulosic material is comminuted wood from old, replaced wooden ties; however, other suitable lignocellulosic materials including but not limited to hardwood or softwood chips, shavings, sawdust and barks, bagasse, straw, rice hulls, corn stalks, reeds, vegetable stems, cork and the like, or mixtures thereof, are also contemplated for use in various proportions depending upon their fibrous characteristics and the required resistance of the finished crosstie to bending-induced tensile stresses. If a substantial proportion of the lignocellulosic mixture is composed of comminuted reclaimed ties, it may be unnecessary to add additional creosote when the new tie is formed as the creosote already in the wood of the old ties may be sufficient to protect the new tie from the effects of exposure. Even if additional creosote is necessary, the amount and cost thereof is much less than would be necessary to achieve the same degree of protection if material other than comminuted reclaimed ties were used, since the existing creosote in the used ties provides the majority of the requirement. This cost saving is highly significant in rendering the tie of the present invention financially competitive with lumber ties. In any case, regardless of the source of the creosote, a monolithic tie of the present invention made from comminuted creosoted lignocellulosic particles will be more resistant to rotting and deterioration from exposure to the elements than creosoted lumber ties since the creosote will be homogeneously mixed throughout the new tie rather than concentrated adjacent the surface.

A particularly efficient mechanical process for converting comminuted lignocellulosic material into the thick, highly densified rigid form of the present invention is described in E. Potter et al U.S. Pat. No. 3,804,935, issued Apr. 16, 1974, which is incorporated herein by this reference. Thermoplastic or thermosetting resin binders of any known suitable type, or preferably a mixture of both, may be utilized as the bonding agent. A densifying pressure of about 1200 psi or more is employed to densify the material to at least about four times and preferably at least five times its uncompressed density, thereby resulting in a final density in the range of 35–50 lbs/ft$^3$ depending on the type of lignocellulosic material utilized, and to form the material to thickness, width and length dimensions at least as great as those of a conventional railroad crosstie so as to produce a monolithic (rather than laminated) tie. The high densification is particularly advantageous by enabling the use of conventional spikes to fasten the rails to the tie by providing the tie with good spike-holding characteristics due to the high internal pressure of the bound lignocellulosic material, and by furnishing the requisite high strength needed for such an application.

The reinforcing members, for example metal or fiber glass rods, need not but may be pretensioned before the tie is molded. The members have a tensile strength and modulus of elasticity greater than that of the bonded particle matrix in which they are embedded, and extend from end-to-end proximate the upper and lower surfaces of the tie on either side of its neutral bending axis. Thus positioned, the rods are proximate and parallel to the different lines of maximum tensile stress that will be induced within the tie when it is subjected to the downward forces of a passing train, as will be explained in detail hereafter. The rods are also located generally in a vertical plane passing through the longitudinal center of the tie, thereby enabling the spikes which fasten the rail to the tie to be driven into the tie on either side of its longitudinal center, as is the convention, without being obstructed or contacted by the rods within the tie. When metal is used for the material of the rods, this positioning also permits metal rails to be fastened to the tie of the present invention by conventional metal spikes without the risk of creating an electrical path between the two rails and interfering with a railway signal system which utilizes the two rails as electrical signal conductors. Radially extending protrusions, for example annular washers, are fixedly attached along the rods in spaced pairs at preselected points substantially equidistant on either side of points of expected maximum tensile stress, to prevent substantial sliding movement between the rods and the lignocellulosic matrix material of the tie and thereby ensuring a maximum effective transfer of the bending-induced tensile stresses from the tie material to the rods as the tie is subjected to the cyclic forces of passing trains.

Surrounding the sides, ends and bottom of each tie when installed in a conventional railway is a ballast of crushed rock or gravel that serves as a supportive surface to spread the load of a passing train over the earthen subgrade below the railway, hold the tracks and ties in position, and act as a drainage system. Over a period of time, this ballast will tend to loosen and deteriorate in supportive capability under the repeated pounding of passing trains, leaving the tie relatively unsupported at some points along its length. If the ballast deteriorates near the ends of the tie, downward pressure exerted against the rails by the wheels of passing trains will cause the ends of the tie to flex downwardly about a fulcrum defined by the ballast at the middle of the railway, thereby bowing the center of the tie upwardly and creating a point of maximum tensile stress in the upper surface of the tie approximately midway between the two rails. By locating a pair of the radially extending protrusions along the upper reinforcing rod such that the protrusions in the pair are spaced approximately equidistant from the midpoint of the tie on either side thereof, the lignocellulosic material near the upper surface of the tie will be prevented from sliding relative to the rod, thereby effectively transferring the tensile stress induced in the material to the reinforcing rod and preventing the material from separating and forming a crack across the top of the tie. Conversely, if the ballast material is loosened along the underside of the tie directly below either of the rails, the downward force exerted by passing trains will cause the tie to bow downwardly under that rail, creating a point of maximum tensile stress in the lower surface of the tie directly below the rail. By locating a pair of protrusions along the lower reinforcing rod such that the protrusions in the pair are spaced equidistant from a given rail on either side thereof, the tensile stresses induced within the lignocellulosic material as the tie bows downwardly will be transferred to the reinforcing rod as before, thereby preventing a stress buildup within the tie sufficient to cause cracking across the bottom of the tie. Thus, by placing rods longitudinally within the tie proximate the lines of maximum expected stress, i.e., above and below the neutral bending axis of the tie, and positioning the radially extending protrusions along the rods in pairs with their members spaced equidistant from the foregoing specific points of anticipated maximum stress buildup, the lignocellulosic material of the tie is reinforced against the specific positive and negative bending forces expected to be encountered by railroad ties under the varying ballast conditions.

It is, therefore, a principal objective of the present invention to provide an economic replacement for a conventional lumber railroad tie, such replacement being made from reclaimed lignocellulosic waste products, especially comminuted reclaimed wooden ties, bonded together into a monolithic tie, thereby saving the lumber required for new wooden ties and obviating problems of lignocellulosic waste disposal, especially relative to old ties.

It is an additional objective of the present invention to provide such a railroad tie that is specially reinforced so as to be particularly resistant to cracking at specific locations along its upper and lower surfaces due to bending-induced cyclic tensile stresses peculiar to railroad ties.

It is an additional objective of the present invention to provide such a railroad tie which has sufficient nail-holding properties due to a high degree of densification that conventional spikes may be used to fasten the rails thereto.

It is an additional objective of the present invention that such tie be more thoroughly protected against deterioration than new lumber ties while requiring a lesser application of creosote preservative to protect the tie.

The foregoing objectives, features and advantages of the present invention will be more readily understood upon consideration of the following detailed description of the invention taken in conjunction with the accompanying drawings.

DETAILED DESCRIPTION OF THE INVENTION

Referring to the figures, the reinforced railroad crosstie of the present invention, indicated generally at 20, is seen to comprise a mixture of comminuted lignocellulosic material 22 bonded by an adhesive binder into the form of a beam 24 around a pair of elongate members, rods 26 and 28, of metal, glass or other suitable material having a higher tensile strength and modulus of elasticity (Young's modulus) than the bonded mixture 22. The lignocellulosic mixture 22 is composed preferably of comminuted wood from old rotted, worn or split railroad ties; however, other fibrous vegetable waste materials may be used alone or in mixtures. Suitable thermosetting and/or thermoplastic binders in sufficient quantities to ensure the formation of a relatively hard, rigid product, as taught by the aforementioned Potter et al U.S. Pat. No. 3,804,935, are mixed with the lignocellulosic materials before they are molded around the rods 26 and 28. The mold in which the beam is to be formed should define an interior enclosure, after compression of the lignocellulosic material and locking of the mold, having thickness, width and length dimensions at least as great as those of a conventional lumber crosstie. If desired, molds with lengths longer than a conventional crosstie may be used and the beams produced therein sawed into shorter lengths. The sides of the mold should be tall enough to hold a sufficient volume of uncompressed material to achieve the previously described degree of densification upon compression. Hardening of the binders used, by curing of a thermosetting binder with or without heat, or heating and subsequent cooling of a thermoplastic binder, are carried out in the mold.

Figure 1:
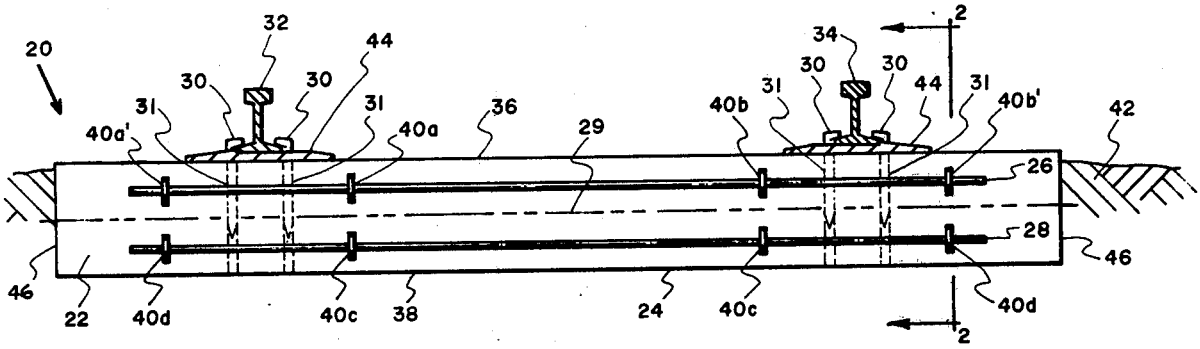
FIG. 1 is a sectional side elevation of the reinforced railroad tie of the present invention shown in place as a component of a conventional railway.
Figure 2:
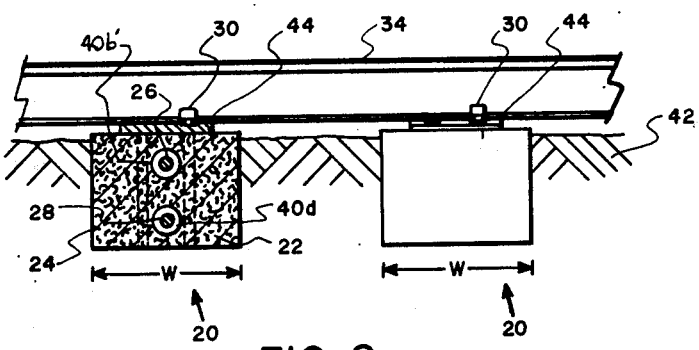
FIG. 2 is an end view of two reinforced railroad ties of the present invention, installed as components of a conventional railway, with one tie sectioned along line 2—2 of FIG. 1.

During the filling of the mold with the mixture of lignocellulosic material and binders, the reinforcing rods 26 and 28 are placed in position and the mixture poured around them by any convenient method such that, after final compression and locking of the mold, the rods are positioned within the mixture 22 in the locations shown in FIGS. 1 and 2. For example, if the crosstie is molded on its side such that its width dimension "w" in FIG. 2 extends upwardly from the base of the mold, the mold may be half filled with a first course of mixture and the rods 26, 28 laid atop in a parallel spaced arrangement, after which the second course may be added atop the rods filling the mold completely. Alternatively, the crosstie can be molded in the same orientation as shown in FIGS. 1 and 2, in which case a relatively thin first course of mixture is spread evenly on the base of the mold, the lower rod 28 is laid atop the first course, and covered by a relatively thick second course; thereafter the upper rod 26 is laid atop the second course, and covered by a relatively thin final course.

With respect to FIGS. 1 and 2 which show a finished crosstie 24, the rods 26 and 28 are positioned with one rod vertically above the other generally in a vertical plane passing through the midpoint of the tie width dimension "w", so as not to interfere with the spikes 30 employed to fasten the rails 32 and 34 to the crosstie as described below. In addition, upper reinforcing rod 26 and lower reinforcing rod 28 are positioned above and below the neutral beam bending axis 29 at locations proximate the crosstie's top surface 36 and bottom surface 38, respectively, so as to lie as close as possible to the lines of maximum tensile stress that will be induced into the beam when it is subjected to certain specific positive and negative vertical bending forces. A plurality of radially-extending protrusions such as 40*a, b, c* and *d* are fixedly attached at selected points along both rods to prevent substantial sliding movement between the rods and the lignocellulosic material of the beam as the beam is flexed. Although these protrusions are depicted as annular washers in the figures, it is anticipated that other shapes may be used as well. These protrusions are spaced along the rods at specific locations relative to points of maximum bending stress as described more fully below.

To form a railway, the reinforced crossties of the present invention are laid side by side as indicated in FIG. 2, with their width dimensions "w" oriented horizontally over a supportive surface, for example, a layer of ballast 42 composed of cinders or crushed stone. This ballast completely surrounds each tie up to the level of its top surface 36 to spread the load of the railway over the earthen subgrade, hold the railway in position, and act as a drainage system. The rails 32 and 34 are attached to the ties by spikes 30 inserted through holes in a metal tie plate 44 and driven into the tie as with conventional wooden ties. The ties are normally pre-bored by means of bore-holes such as 31 to receive the spikes, thereby minimizing the risk of splitting the tie. Normally, two spikes 30 are employed to attach a rail to a tie, the spikes being driven into the tie on either side of the rail at points on either side of the midpoint of the width dimension "w" as shown in the figures. As the reinforcing rods 26 and 28 are positioned within beam 24 one above the other at such midpoint, the spikes 30, when driven in their conventional locations, will pass on either side of the reinforcing rods without making contact therewith. This enables the use of conventional rail spikes in the bonded material, which has been sufficiently densified to receive and hold them, by ensuring that they will not be obstructed by the reinforcing rods and that no electrically conductive path is created between the two rails by the inclusion of metal reinforcing rods within the tie.

Figure 3:
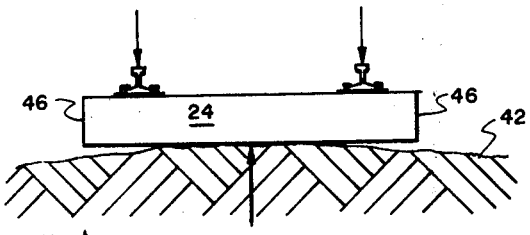
FIG. 3 is a simplified side view of an exemplary tie depicting, in exaggerated form, the underlying ballast in a deteriorated condition adjacent the ends of the tie and the resultant force vectors directed against the tie.
Figure 4:
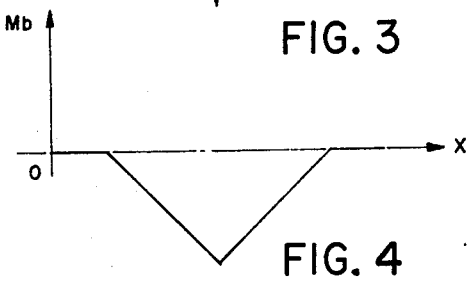
FIG. 4 is a diagram indicating the negative bending moments exerted by the weight of a train on the exemplary tie of FIG. 3.

The specific locations of the protrusions 40 are determined by the locations of anticipated maximum tensile stress in the crosstie. After repeated pounding by the wheels of passing trains against the rails and ties of the railway, the ballast 42 packed around the ties may begin to loosen in certain locations, thereby removing a portion of the tie's support and subjecting it to beam loading. When the ballast loosens near the ends 46 of the tie, as depicted in FIG. 3, the downward forces exerted by passing trains will thereafter cause the ends of the tie to bow downwardly about its middle creating a bending moment diagram roughly as shown in FIG. 4 with a maximum negative bending moment at approximately the midpoint of the tie including a resultant maximum tensile stress in the upper surface 36 of the tie at the same point. To insure that such tensile stress is transferred from the bonded particle mixture 22 to the upper reinforcing rod so as to prevent undue deflection and cracking of the tie at such point, two of the washer-like protrusions 40*a* and 40*b* are attached to the upper reinforcing rod 26 as shown in FIG. 1 at locations spaced substantially equidistant from the midpoint of the tie. The relationship of the protrusions 40*a* and 40*b* to this particular point of maximum tensile stress, coupled with the location of the upper reinforcing rod above the neutral bending axis 29 and near the upper surface 36 of the crosstie 24, ensures that a substantial proportion of the tensile stress induced within the lignocellulosic material from the negative bending will be transferred to the rod, which is prevented from slipping longitudinally relative to the lignocellulosic material by the protrusions on either side of the point of maximum stress. A second pair of protrusions such as 40*a'*, 40*b'* are preferably provided in the upper rod 26 to supplement structurally the first pair of protrusions 40*a*, 40*b*.

Figure 5:
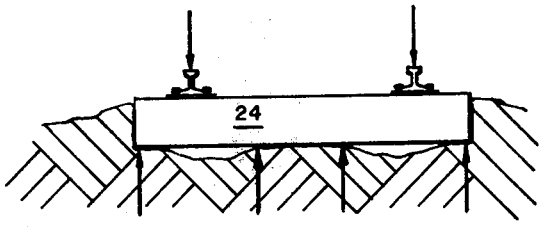
FIG. 5 is a simplified side view of an exemplary tie depicting, in exaggerated form, the underlying ballast in a deteriorated condition beneath each rail and the resultant force vectors directed against the tie.
Figure 6:
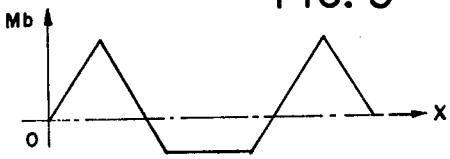
FIG. 6 is a diagram indicating the predominantly positive bending moments exerted by the weight of a train on the exemplary tie of FIG. 5.

If the repeated pounding of passing trains causes the ballast 42 to loosen around the lower surface of the tie directly below one or both of the rails, as depicted in FIG. 5, without also loosening at the adjacent end of the tie, the downward force exerted by the train against the rail will thereafter cause the tie to bow downwardly beneath the rail, creating a bending moment diagram roughly as shown in FIG. 6 and inducing a point of maximum tensile stress in the lower surface 38 of the beam directly below the rail. To reinforce the beam against this stress, two of the washer-like protrusions 40*c* and 40*d* are attached to the lower rod 28 as shown in FIG. 1 at points substantially equidistant from, and spaced on either side of, a vertical line through the center of the rail and, therefore, equidistant from the particular point of maximum tensile stress induced by such positive bending. It should be noted that such point of maximum stress is also located between inner and outer bore holes 31, and that therefore the protrusions 40*c* and 40*d* are spaced on either side longitudinally of the pair of bore holes. As before, the location of the rod 28 below the neutral bending axis 29, and the placement of the protrusions 40*c* and 40*d*, ensure that a substantial amount of the tensile stress induced within the lower surface 38 of the tie will be transferred to the rod without longitudinal slippage of the rod relative to the tie material, thereby preventing a stress buildup sufficient to cause cracking of the tie.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A reinforced railroad crosstie comprising:

(a) an elongate monolithic beam of compressed, bonded comminuted lignocellulosic material, said beam having horizontally extending length and width dimensions and a vertically extending thickness dimension;

(b) means defining two groups of downwardly extending holes formed in the upper surface of said beam for receiving rail fasteners, said groups being spaced longitudinally from one another on each side of the midpoint of said length dimension of said beam;

(c) a plurality of elongate reinforcing means longitudinally positioned within said beam for increasing the resistance thereof to bending, an upper one of said reinforcing means being located above the neutral bending axis of said beam and extending longitudinally through the midpoint of said length dimension of said beam, and a lower one of said reinforcing means being located below said neutral bending axis and extending longitudinally through the locations of said groups of holes to locations on both sides of each of said groups of holes;

(d) a plurality of laterally extending protrusions within said beam fixedly attached to said upper and lower reinforcing means, two of said protrusions being positioned along said upper reinforcing means as a first spaced pair, said first pair of protrusions being spaced longitudinally from one another and located on either side of the midpoint of said length dimension of said beam at positions adjacent a respective one of said groups of holes, said upper reinforcing means being free of any said protrusion between said first pair of protrusions; and (e) at least two further pairs of said protrusions being positioned along said lower reinforcing means as second and third spaced pairs, the protrusions of each of said second and third pairs respectively being spaced longitudinally with respect to one another and located on either side of a respective one of said groups of holes, said lower reinforcing means being free of any said protrusion between the protrusions of said second pair and between the protrusions of said third pair respectively.

2. A railway assembly comprising:

(a) a crosstie lying horizontally on a supportive surface, said crosstie comprising an elongate monolithic beam of compressed, bonded comminuted lignocellulosic material having the general shape of a conventional railroad crosstie;

(b) a pair of tie plates spaced longitudinally along the upper surface of said beam on either side of the longitudinal midpoint thereof;

(c) a pair of spaced, parallel, train-supporting rails each lying on the upper surface of a different one of said tie plates and extending transversely to said beam so as to be operatively supported thereby;

(d) fastening means for attaching said rails and tie plates to said beam;

(e) a plurality of elongate reinforcing means longitudinally positioned within said beam for increasing the resistance thereof to bending, an upper one of said reinforcing means being located above the neutral bending axis of said beam and extending longitudinally through said beam midpoint, and a lower one of said reinforcing means being located below said neutral bending axis and extending longitudinally with respect to said beam beneath said rails to locations on both sides of each of said rails;

(f) a plurality of laterally extending protrusions within said beam fixedly attached to said upper and lower reinforcing means, two of said protrusions being positioned along said upper reinforcing means as a first spaced pair, said first pair of protrusions being spaced longitudinally from one another and located on either side of said midpoint of said beam at positions adjacent a respective one of said rails, said upper reinforcing means being free of any said protrusion between said first pair of protrusions; and (g) at least two further pairs of said protrusions being positioned along said lower reinforcing means as second and third spaced pairs, the protrusions of each of said second and third pairs respectively being spaced longitudinally with respect to one another and located on either side of a respective one of said rails, said lower reinforcing means being free of any said protrusion between the protrusions of said second pair and between the protrusions of said third pair respectively.

* * * * *

UNITED STATES PATENT AND TRADEMARK OFFICE

CERTIFICATE OF CORRECTION

PATENT NO. : 4,150,790

DATED : April 24, 1979

INVENTOR(S) : Edward Potter

It is certified that error appears in the above-identified patent and that said Letters Patent are hereby corrected as shown below:

Col. 6, line 39 Change "including" to --inducing--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*